United States Patent [19]

Wagenseil et al.

[11] Patent Number: 4,576,554

[45] Date of Patent: Mar. 18, 1986

[54] SWASHPLATE AXIAL PISTON PUMP

[75] Inventors: Ludwig Wagenseil, Vöhringen; Manfred Lotter, Neu-Ulm, both of Fed. Rep. of Germany

[73] Assignee: Hydromatik GmbH, Elchingen, Fed. Rep. of Germany

[21] Appl. No.: 669,106

[22] Filed: Nov. 7, 1984

[30] Foreign Application Priority Data

Nov. 8, 1983 [DE] Fed. Rep. of Germany ..... 3340333

[51] Int. Cl.[4] ..... F04B 1/28

[52] U.S. Cl. ..... 417/270; 417/307

[58] Field of Search ..... 417/269, 270

[56] References Cited

U.S. PATENT DOCUMENTS

| | | | |
|---|---|---|---|
| 2,138,194 | 11/1938 | Pfauser | 417/269 |
| 2,797,647 | 7/1957 | Floraday | 417/269 |
| 2,990,781 | 7/1961 | Tuck et al. | 417/270 |
| 4,236,878 | 12/1980 | Terauchi | 417/269 |
| 4,290,345 | 9/1981 | Hiraga | 417/269 |

FOREIGN PATENT DOCUMENTS

| | | | |
|---|---|---|---|
| 1939242 | 7/1970 | Fed. Rep. of Germany | 417/27C |
| 1201441 | 11/1957 | France | 417/27C |
| 1189369 | 10/1959 | France | 417/27C |
| 1344108 | 10/1963 | France | 417/269 |
| 2307983 | 12/1976 | France | 417/269 |
| 297542 | 3/1954 | Switzerland | 417/269 |

*Primary Examiner*—William L. Freeh

*Attorney, Agent, or Firm*—Scully, Scott, Murphy & Presser

[57] ABSTRACT

The invention relates to a swash plate axial piston pump having several pistons, the piston heads of which are held in contact with the swash plate by means of a retraction plate, and having a central pressure-regulating valve which is forced against a valve spring by the pressure in the pressure chamber. The object is to provide a way of fixing the retraction plate on the swash plate which is simple and cheap to construct and install.

This is achieved by arranging and fixing the valve spring between the valve body and the retraction plate.

13 Claims, 1 Drawing Figure

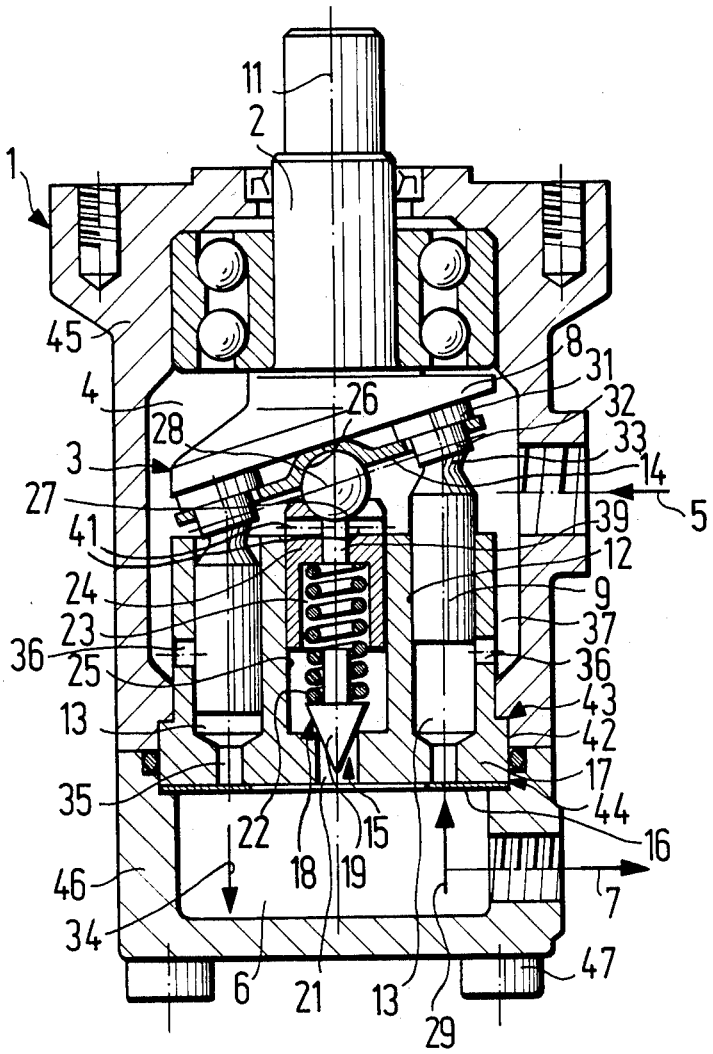
11
2
1
45
4
26
8
31
32
28
33
3
14
27
5
41
39
12
24
9
23
37
36
25
36
43
13
42
17
35
44
22
15
16
18
19
46
7
34
47
6
21
13
29

SWASHPLATE AXIAL PISTON PUMP

TECHNICAL FIELD OF THE INVENTION

The invention relates to a swashplate axial piston pump according to the preamble of claim 1.

BRIEF DESCRIPTION OF THE PRIOR ART

A swashplate axial piston pump having several pistons, as specified in the preamble of claim 1, is disclosed in German Offenlegungsschrift No. 19 39 242. The piston heads are held in contact with the swash plate by means of a retraction plate. A pressure spring acts indirectly on the retraction plate and is supported on a structural member of the axial piston pump which member is fixed in relation to the housing. In the known construction a regulating valve upon which the pressure in the pressure chamber is able to act against a spring force and which establishes a connection between the pressure chamber and the suction chamber above a certain pressure, is arranged centrally between the pistons. The spring force of the regulating valve is generated by a pressure spring which acts upon the valve spool and which is indirectly supported on the retraction plate. Thus, in the known construction, there are two pressure springs whose effects can overlap although mutual influence is not intended and is not even effective, as the spring force of the valve spring is low compared with the force of the pressure spring which holds the retraction plate on the swash plate. The latter is to be adjusted so that it is greater than the force which tends to lift the retraction plate from the swash plate whilst the axial piston pump is in operation.

A swash plate axial piston pump of this type is described and represented in German Auslegeschrift No. 10 01 593. In the case of this known axial piston pump, the retraction plate is supported on a spherical head and is fixed in the direction of the feed movement of the pistons by means of an arrangement which is specifically provided for that purpose, namely, a flange on the swash plate. A construction of this kind is not only expensive to produce and install but it also gives rise to a great deal of running noise because of the rattling of the retraction disc, particularly after a prolonged running period (wear).

OBJECT OF THE INVENTION

The underlying object of the invention is to find a way of fixing the retraction plate to the swash plate which is simple and cheap to construct and which is also easy to install.

BRIEF DESCRIPTION OF THE INVENTION

This object is achieved by means of an arrangement according to claim 1. In an arrangement according to the invention, the spring force of the spring which acts upon the valve body in the pressure-regulating valve, is used to fix the retraction plate on the swash plate. This fixing is elastic so that play cannot develop in the bearing, for example because of wear, and the running noise can, therefore, be kept at a low level. The fixing does not require a special, specifically provided arrangement but uses one which is already present and which is constructed according to the invention. According to claim 2 a spring piston is inserted between the valve spring and the retraction plate. This is advantageous for production and installation. The spherical sliding surface necessary for the support of the retraction plate may be formed on the spring piston.

Moreover, supporting surfaces according to claim 4 for the valve spring can be formed on the spring piston in a simple manner.

In an arrangement according to claim 5 the hydraulic fluid is conducted from the pressure chamber back into the suction chamber when the pressure-regulating valve opens.

The construction according to claim 6 results in a back-up for the force which acts upon the retraction plate towards the swash plate when the pressure-regulating valve opens. This reinforcement is based upon dynamic pressure which is built up when the hydraulic fluid flows off through the channel in the hollow cylinder.

The arrangement according to claim 7 is advantageous because a channel can be produced simply and cheaply in the spring piston as a small separate structural part.

If a sphere is inserted between the retraction plate and the spring piston it is recommended that the spring piston and the channel be constructed as in claim 8.

An embodiment which is likewise advantageous both to produce and to install is included in claim 9. In this case the working surfaces which are to be produced with a comparatively high level of precision are concentrated in a pump block in which they can expediently be incorporated. Moreover, the pump block comprises the delicate wearing parts of the swash plate axial piston pump so that when these portions become worn, they can be exchanged easily and simply. In addition, after the pump block has been installed, it automatically provides the separation between the suction and pressure chambers.

The arrangement described above also renders possible in a simple manner the coordination of a diaphragm valve plate if the pressure channels are constructed according to claim 10.

According to claim 11, the valve body has, in a manner known per se, a well tested cone head or spherical head.

The form of suction chamber described in claim 12 is advantageous because provision can be made for it from the start when a cast part is used and no special processing is therefore required. Thus, for the purpose of connecting the working areas with the suction chamber all that is needed are short radial bore holes which can be incorporated easily and quickly on the pump block.

According to claim 13 the pressure-regulating valve is a pressure relief valve which is closed up to a given working pressure and only opens when this pressure is exceeded, for example, for reasons of safety so that hydraulic fluid can flow back out of the pressure chamber to the suction chamber and higher pressure cannot, therefore, build up in the pressure chamber. The force of the valve spring and the opening surface on the cone or spherical head are, therefore, coordinated with each other in a predetermined manner.

BRIEF DESCRIPTION OF THE DRAWING

An exemplary embodiment of the invention is described in greater detail in the following with the aid of a simplified drawing. The swash plate axial piston pump is represented in this drawing in a longitudinal section.

)ETAILED DESCRIPTION OF A PREFERRED EMBODIMENT OF THE INVENTION

The swash plate axial piston pump comprises a hous- ;g indicated generally as 1, a drive shaft 2, a pumping ıechanism indicated generally as 3, a suction chamber to which a suction line 5 which is represented as an 'row, may be connected and a pressure chamber 6 to hich a pressure line 7, which is also represented as an 'row, may be connected.

The pumping mechanism 3 consists of a swash plate 8 hich is arranged at the end of the drive shaft 2 and hich is to be set in rotation by the latter, several pis- ›ns 9 which are arranged in a circle and are guided ong the axis 11 of the pump in hollow cylinders 12 and hich form working areas 13 in front of their free front ıes, a retraction plate 14 (described hereinafter), a 'essure relief valve indicated generally as 15, a dia- ıragm valve plate 16, and a pump block 17 in or on hich the movable parts of the pumping mechanism 3 e received.

The pressure relief valve 15 is arranged centrally ong the axis of the pump 11 and consists of a valve ›dy 18, the cone head 19 of which cooperates with a ılve seat (bore hole) 21, and a valve spring 22 which, ı the one hand, acts on the cone head 19 and, on the her hand, is received in a coaxial bore hole 23 of a ring piston 24.

The spring piston 24 can be moved along the pump is 11 in a hollow cylinder 25, the base of which forms e valve seat 21. The retraction plate 14 and the spring ston 24 have opposed concave sliding surfaces 26, 27 hich are formed as spherical segments and between hich a sphere 28 is housed. In operation, the rotating ′ash plate 8 gives rise to a reciprocating movement of e pistons 9. The retracting movement 29 of the pistons takes place in each case through the retraction plate , which grips from behind the flanges 31 of sliding oes 32 which embrace spherically-shaped heads 33 of e pistons 9. As the valve spring 22 is supported on the ring piston 24, the spring force which it generates is ınsferred by the sphere 28 to the retraction plate 14, hereby the latter is pressed against the swash plate 8 d is thus fixed. The spring force of the pressure relief lve 15 is thus used at the same time for the purpose of ing the retraction plate 14.

When the pistons 9 execute the feed movement 34, e hydraulic fluid in the working areas 13 is forced rough pressure channels 35 into the pressure chamber lifting the diaphragm valve plate 16 which immedi- ›ly closes again after the feed movement 34 is com- ›ted. When the pistons 9 free radial suction channels in the course of their return movement 29, hydraulic ıid is sucked out of the suction chamber 4 which ex- ıds into an annulus 37 which surrounds the pump ›ck 17, into the working areas 13 where the hydraulic ıid is available to be forced into the pressure chamber ›y the next feed movement 34 of the pistons 9.

When the pressure in the pressure chamber 6 exceeds ›redetermined value, the valve body 18 of the pres- re relief valve 15 opens so that hydraulic fluid can 'w back into the suction chamber 4 through the hol- ′ cylinder 25 and through an axial channel 39 and lial channels 41 in the spring piston 24.

The pump block 17 has a flange 42 which forms ›ulders 43,44. The pump block 17 is clamped by these ›ulders 43,44 between a first part 45 and a second part of the housing so that the said block is simultaneously embraced on its periphery in a form-locking manner and is thus fixed both axially and radially. This clamping also serves, at the same time, to secure the diaphragm valve plate 16 which the shoulder 44 overlaps.

For repair or inspection, all that is necessary is to unscrew the screws 47 and to remove the second part 46 of the housing which encloses and covers the pressure chamber 6. The pressure side of the pump block 17 is then exposed. If a close inspection of the pumping mechanism 3 is necessary, the pump block 17 can be simply drawn out axially. Installation is similarly simple and easy by inserting the whole pumping mechanism 3 with the exception of the swash plate 8 in the exposed pump block 17.

What is claimed is:

1. A swashplate axial piston pump comprising a housing including a suction chamber and a discharge chamber, a pump block extending inside the housing and including a plurality of piston bores, a plurality of pistons supported for reciprocating movement in the piston bores, each piston including a piston head, a swashplate supported in the housing to reciprocate the piston, a retraction plate for holding the piston heads against the swashplate, a pressure-regulating valve assembly in communication with the suction and discharge chambers to conduct fluid therebetween, said valve assembly including a valving body disposed centrally between the pistons to control fluid flow through the valve assembly, and moving to a position opening the pressure-regulating valve assembly when the pressure in the discharge chamber exceeds the pressure in the suction chamber by a predetermined pressure; and means consisting of a single spring disposed and clamped between the valving body and the retraction plate, and both urging the retraction plate to a position securely holding the piston heads against the swashplate and simultaneously urging the valving body to a position closing the pressure-regulating valve assembly.

2. Swashplate axial piston pump according to claim 1, characterized in that the valving body has a cone head or spherical head.

3. Swash plate axial piston pump according to claim 1, characterized in that the pressure-regulating valve assembly is a pressure relief valve.

4. Swashplate axial piston pump according to claim 1, characterized in that the housing includes first and second sections, and the pump block includes a flange or the like extending between the first and second housing sections and separating the suction chamber and the discharge chamber, and further including means releasably connecting together the first and second housing sections.

5. Swashplate axial piston pump according to claim 4, further including a diaphragm valve plate held between the flange and the second section of the housing and covering the piston bores to control the discharge of fluid therefrom.

6. Swashplate axial piston pump according to claim 1, characterized in that the spring is supported in the direction of the retracting movement of the pistons on a spring piston which is guided in a hollow cylinder in the pump block for movement along the axis of the pump.

7. Swashplate axial piston pump according to claim 6, characterized in that the spring piston and the retraction plate each include sliding surfaces in the shape of spherical segments, and in that a sphere is clamped between the spring piston and the retraction plate to transmit forces therebetween.

8. Swash plate axial piston pump according to claim 6, characterized in that the end of the spring remote from the valving body is received in a hole of the spring piston or on a projection of the same.

9. Swashplate axial piston pump according to claim 1, characterized in that the valve assembly includes channel means extending between the suction and discharge chambers, and the valving body is arranged in said channel means.

10. Swashplate axial piston pump according to claim 9, characterized in that the spring is supported in the direction of the retracting movement of the pistons on a spring piston which is guided in a hollow cylinder in the pump block, the hollow cylinder comprising a part of the channel means on that side of the spring piston which is remote from the retraction plate.

11. Swash plate axial piston pump according to claim 10, characterized in that the channel means extends longitudinally through the spring piston.

12. Swashplate axial piston pump according to claim 11, characterized in that a portion of the spring piston extends into the suction chamber and includes a T-shaped branch comprising another part of the channel means.

13. Swashplate axial piston pump according to claim 12, characterized in that the suction chamber includes an annular portion extending around the pump block; and the pump block includes radial suction channels to conduct fluid from the annular portion into the piston bores.

* * * * *